United States Patent [19]

Landry

[11] Patent Number: 4,540,117

[45] Date of Patent: Sep. 10, 1985

[54] TRANSIT FARE BOX

[76] Inventor: Brian J. Landry, 1547 Wilson Rd., Macedon, N.Y. 14502

[21] Appl. No.: 671,999

[22] Filed: Nov. 16, 1984

[51] Int. Cl.[3] ..... G07B 15/00

[52] U.S. Cl. ..... 232/7; 232/44; 232/56

[58] Field of Search ..... 232/7, 12, 44, 56; 133/8 E; 194/1 E, 4 R, 4 E

[56] References Cited

U.S. PATENT DOCUMENTS

| | | | |
|---|---|---|---|
| 150,500 | 5/1874 | White | 232/56 |
| 1,212,662 | 1/1917 | Meyers | 194/4 R |
| 4,130,238 | 12/1978 | Williams | 232/7 |
| 4,214,654 | 7/1980 | Pryor et al. | 194/1 E |
| 4,453,667 | 6/1984 | Zerfahs | 232/7 |

*Primary Examiner*—Gene Mancene
*Assistant Examiner*—Cary E. Stone
*Attorney, Agent, or Firm*—Shlesinger, Fitzsimmons & Shlesinger

[57] ABSTRACT

The fare box contains an elongate, vertically disposed chute, the upper end of which registers with a slot formed in the top of the box for inserting paper currency into the chute. The chute has a cross sectional area substantially greater than that of a dollar bill, so that once the bill has been inserted into the chute, whether rolled or folded, it could fall by gravity downwardly through the chute to a space provided therefor in the bottom of the box. An endless belt is mounted adjacent the chute to be driven unidirectionally in a path which causes one run of the belt to travel vertically downwardly in a groove formed in one side of the chute. At equi-spaced intervals along its length the belt carries a plurality of transverse tine-supporting bars, which carry a plurality of spaced, parallel tines or fingers that project part way into the bore of the chute as the support bars travel downwardly in the chute. The tines engage any objects which may become lodged in the upper end of the chute, and positively drive such objects downwardly through the chute into the space at the bottom of the box.

14 Claims, 6 Drawing Figures

TRANSIT FARE BOX

BACKGROUND OF THE INVENTION

This invention relates to fare boxes of the type employed on public conveyances, such as transit buses or the like, and more particularly to an improved fare box which is designed to accept paper currency, such as for example a dollar bill.

In more recent years the cost of transportation has sky-rocketed, thus leading to increased fares for subways, buses, and the like, even to the point where it has been necessary to design fare boxes capable of handling or accepting both coins and paper currency, typically in the form of dollar bills. Unfortunately, however, known fare boxes of the type capable of receiving and manipulating dollar bills have the disadvantage that they easily become jammed and therefore frequently are in need of repair.

For example, in a known fare box of the type noted above, the device for accepting paper currency utilizes a bill feed mechanism which requires rather careful placement of a dollar bill or the like into a chute which communicates with the nip formed between the glass or transparent front wall of the box, and the surface of an endless belt which travels downwardly and in slidable engagement with the rear surface of the transparent box wall. As the leading edge of the dollar bill enters the nip, the belt frictionally engages the bill and draws it downwardly into the fare box, causing it to slide against the rear face of the transparent wall of the box. A major disadvantage of this type of fare box is that a great variety of foreign objects, unfortunately, are frequently inserted into the bill receiving chute, and as a consequence the mechanism all too frequently becomes jammed and requires the associated transit vehicle be removed from operation to allow repair of the jammed mechanism.

It is an object of this invention, therefore, to provide an improved fare box of the type described which utilizes a novel mechanism for accepting paper currency, and which minimizes if not substantially eliminates the undesirable jamming and breakdown of the bill delivering mechanism as heretofore experienced in connection with known such fare boxes.

SUMMARY OF THE INVENTION

The improved fare box includes an enlongate, generally rectangularly shaped chute, which is formed in the fare box housing beneath a slot located through which paper currency, such as dollar bills, are adapted to be dropped into the chute. The bore in the chute has a substantially enlarged cross sectional area, as compared for example to the cross sectional area of a dollar bill (whether folded or rolled), so that it is not necessary to flatten the bills out nor to insert them in any particular manner in the slot. They may be rolled up or folded in any desired manner, provided they can be inserted downwardly through the slot and into the upper end of the chute, through which the bill tends to drop by gravity into a storage space formed in the box beneath the chute.

Mounted adjacent the chute is an endless belt, which is driven unidirectionally by a small electric motor, and in such manner that one run of the belt travels downwardly in a groove formed in one side of the chute. Fastened to the belt at equi-spaced points therealong are several transversely extending bars, each of which carries a plurality of spaced, parallel tines that project part way into the chute during movement of the associated bar downwardly in the chute. As they pass into the top of the chute these tines tend to engage and force downwardly into the chute, and out of the bottom thereof, any objects including dollar bills or the like which happen to be dropped into the upper end of the chute. As a consequence the chute never becomes jammed, and the shut-down time of the associated vehicle is minimized. Furthermore, the cross sectional area of the chute and the space between the tines on the endless belt are such that if desired, coins also may be dropped downwardly through the chute to the bottom of the fare box.

THE DRAWINGS

DETAILED DESCRIPTION OF THE DRAWINGS

Figure 1:
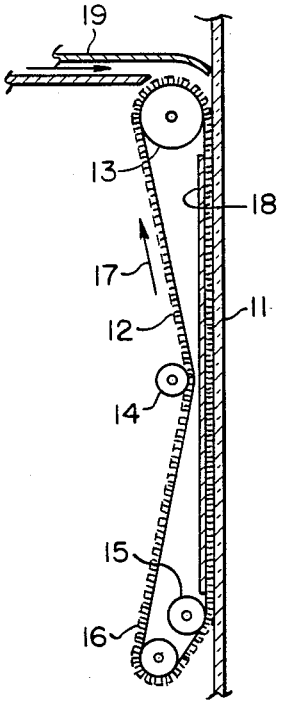
FIG. 1 (PRIOR ART)
FIG. 1 is a fragmentary side elevational view illustrating diagramatically and in section part of a typical transit fare box of the type heretofore employed for receiving paper currency, such as dollar bills.
Figure 2:
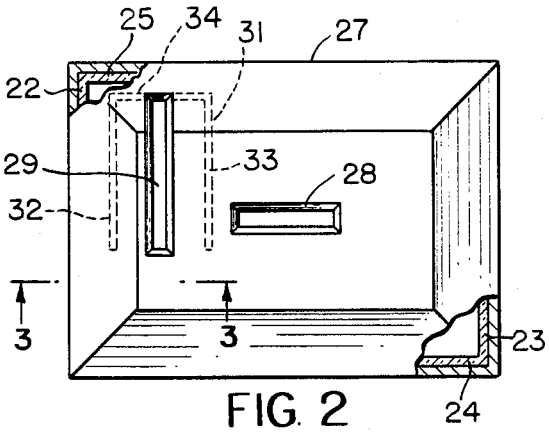
FIG. 2 is a plan view of an improved fare box made according to one embodiment of this invention, portions of the box being broken away and shown in section.

Referring now to the drawings by numerals in reference, and first to the conventional fare box shown fragmentarily in FIG. 1, 11 denotes the transparent front wall or face of the box; and I1 denotes an endless belt that is mounted to travel about rolls 13, 14, 15 and 16 in the direction of arrow 17, so that one section or run thereof passes between the rear face of wall 11 and a stationary backup plate 18. A currency guide chute 19 of conventional design registers with the upper end of belt 12, so that when a dollar bill or similarly shaped currency is fed into the chute 18, it is advanced into the nip formed between the glass wall 11 and the upper end of the belt. The surface of the belt, which may be made of Astro Turf of some similar nape, frictionally grips and feeds the currency downwardly between the belt and wall 11 until the currency drops into a space provided in the box beneath the lower end of the belt.

An obvious problem of fare boxes of this type is that any foreign matter, which is inserted through the chute 19 into contact with belt 12, may become jammed between the wall 11 and the backup plate 18 as it is fed downwardly by the belt. In practice this occurs frequently on public conveyances of the type employing such boxes, and consequently requires removal of the associated vehicle (bus, trolley car, etc.) from service long enough to repair the damaged currency feed mechanism.

Referring now to FIGS. 2 to 6, 20 denotes generally a rather deep, rectangularly-shaped receptacle or housing having spaced parallel, metal side walls 22 and 23, a transversely extending back wall 24 (FIG. 2), which is also made of metal, and a transparent front wall 25 that extends between the front edges of the walls 22 and 23, parallel to the rear wall 24. Housing 20 is closed at its upper end by a rectangular cap 27 having in its center a slot 28 through which coins can be dropped into housing 20 in the usual manner. Adjacent one side thereof cap 27 has therein a second slot 29, which extends transversely of slot 28, and which is adapted to receive paper currency, such as a dollar bill or the like, as noted hereinafter.

Mounted in housing 20 beneath slot 29 is an elongate, channel-shaped member 31 having spaced, parallel side walls or legs 32 and 33 interconnected along their forward edges by a transversely extending end wall 34, which is disposed in spaced, confronting relation to the transparent housing wall 25. Member 31 is secured to the housing side wall 22 by a pair of bolts 36, which pass through circular spacer members 37 and the channel wall 32, against which they are secured by conventional nuts, or the like, so that the currency slot 29 in cap 27 registers centrally with the space between the channel legs 32 and 33. Secured along opposite side thereof to the marginal edges of the channel legs 32 and 33 intermediate ends thereof, and disposed in spaced, parallel relation to the end wall 34 of channel 31, is a vertically disposed chain guide plate 41, which has in its inner surface (the surface which confronts the channel wall 34) a centrally disposed, vertically extending notch or groove 42 for a purpose noted hereinafter.

Secured to the channel legs 32 and 33 adjacent the upper end of guide plate 41 are two right-angular brackets 43 and 44, respectively, each of which has rearwardly projecting arms in which are mounted opposite ends of a pair of spaced, parallel shafts 45 and 46 rotate in a common plane about axes that extend normal to slot 29 and the channel legs 32 and 33. Secured adjacent its upper end to a plate 47, which extends transversely between the lower edges of brackets 43 and 44, is a small, fractional horsepower electric motor 51 having a operating shaft 52, which projects upwardly through a registering opening in the plate 47 and into the space between shafts 45 and 46. A worm gear 53 (FIGS. 5 and 6), which is fixed to the upper end of the motor shaft 52, has driving engagement with a pinion gear 54 (FIG. 5), which is fixed to shaft 46 adjacent one end thereof. Also fixed to shaft 46 adjacent the gear 54 is a sprocket wheel 55, which registers with a like sprocket wheel 56 that is secured to shaft 45 intermediate its ends.

Figure 3:
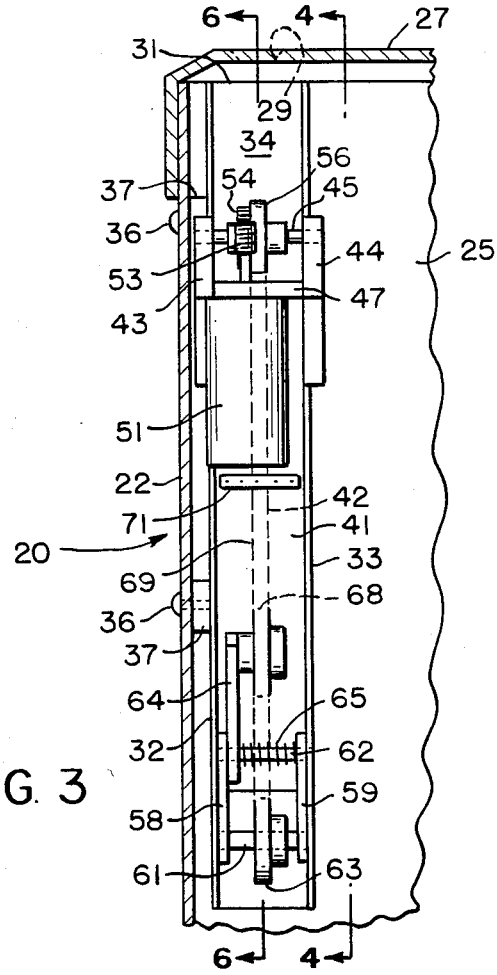
FIG. 3 is fragmentary sectional view taken generally along the line 3—3 in FIG. 2 looking in the direction of the arrows.
Figure 4:
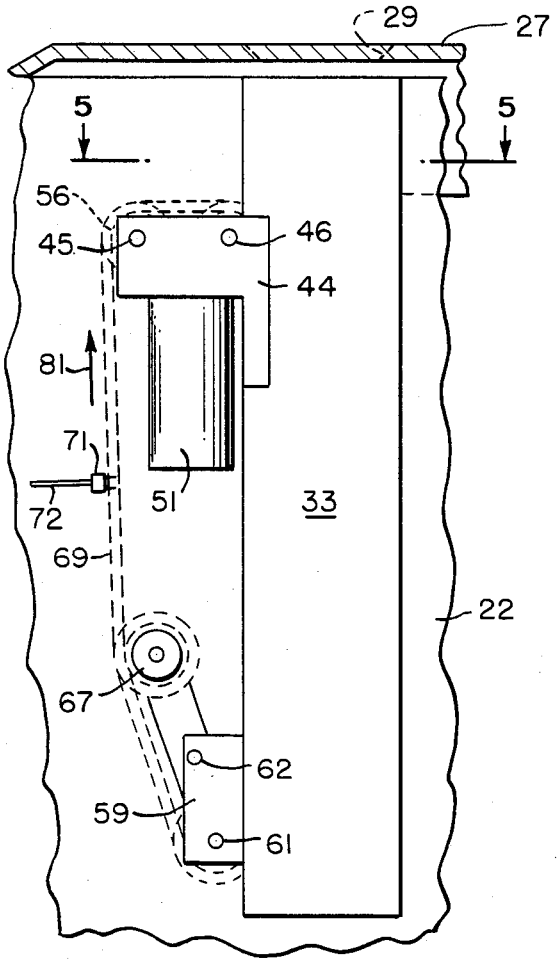
FIG. 4 is a slightly enlarged, fragmentary sectional view taken generally along the line 4—4 in FIG. 3 looking in the direction of the arrows.
Figure 5:
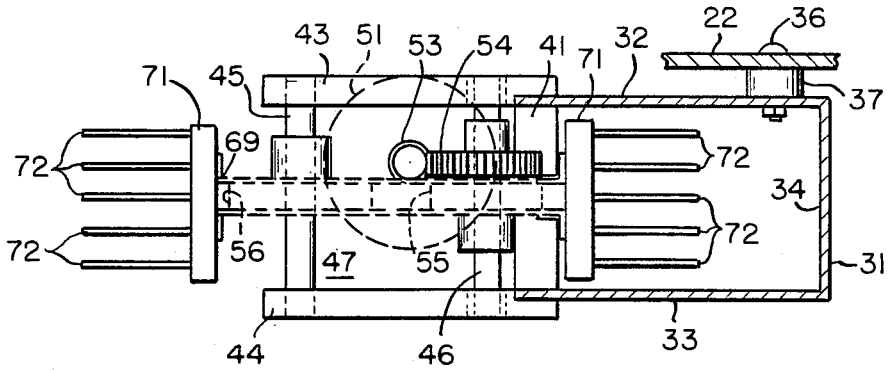
FIG. 5 is a greatly enlarged, fragmentary sectional view taken generally along the line 5—5 in FIG. 4 looking in the direction of the arrows.
Figure 6:
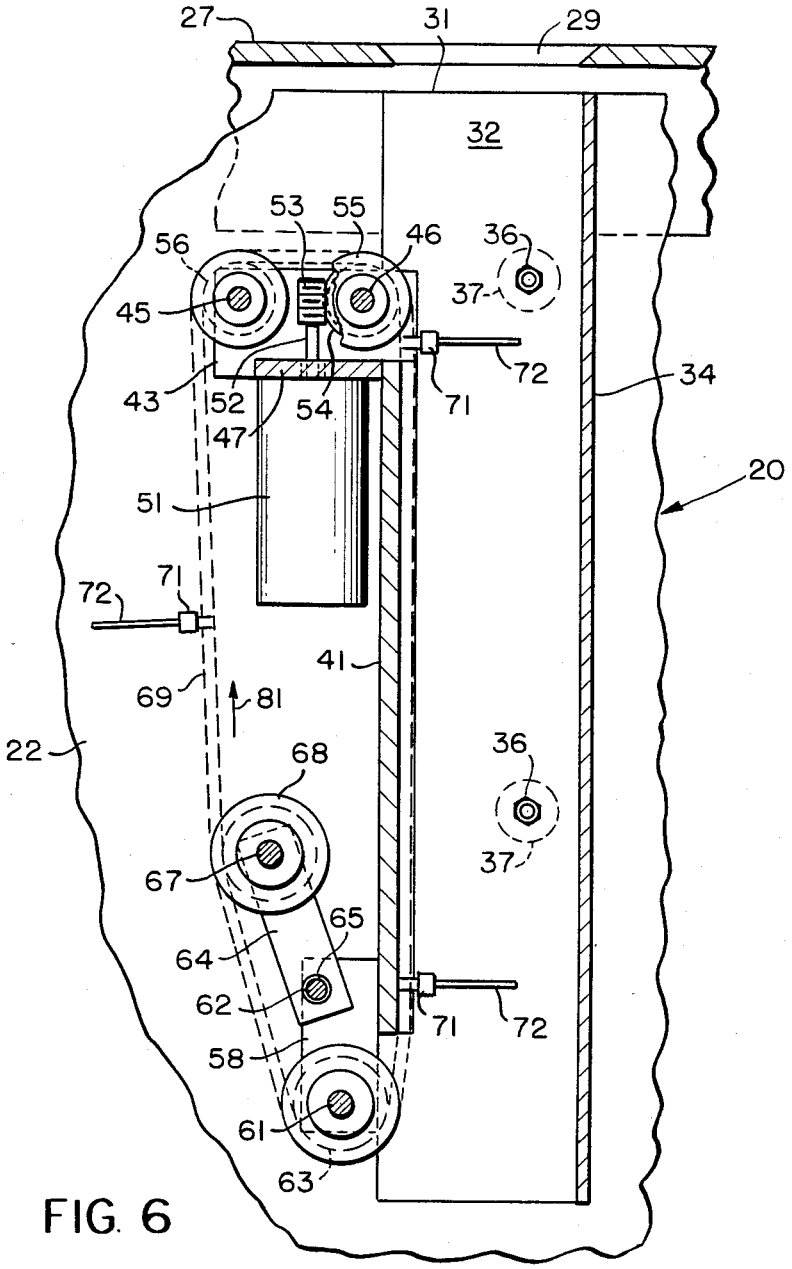
FIG. 6 is a fragmentary sectional view taken generally along the line 6—6 in FIG. 3 looking in the direction of the arrows.

Secured to and projecting rearwardly from the channel legs 32 and 33 adjacent the lower end of guide plate 41 are two, spaced, parallel mounting plates 58 and 59, (FIGS. 3 and 4). Mounted at opposite ends thereof in plates 58 and 59 are extending transversely therebetween parallel to shafts 45 and 46 are two further shafts 61 and 62. Shaft 61, which is spaced beneath shaft 62, has secured thereon intermediate ends an idler sprocket wheel 63. Mounted adjacent its lower end on the shaft 62 by a torsion spring 65, which surrounds shaft 62 between plate 59 and arm 64. Secured at one end in the upper end of arm 64 and projecting from one side thereof (the right side of FIG. 3) and in spaced, parallel registry with the shaft 61, is a pin 67. Mounted to rotate on pin 67 in vertical plain common to the sprocket wheels 55, 56, and 63 is an idler sprocket wheel 68.

Mounted to travel in an endless path around the outsides of the sprocket wheel 55, 56, 63 and 68, and through the groove 42 in the guide plate 41, in an endless sprocket chain 69. This chain carries three tine supporting bars 71, each which is secured intermediate its ends to the chain to extend transversely across the outer surface thereof at each of three equi-spaced points along its length. Each bar of 71 has a length slightly less than the distance separating the channel legs 32 and 33, and has projecting from its outer surface a plurality of (five in the embodiment illustrated) of elongate, parallel, generally flexible metal tines or teeth 72, which project equi-distantly from the associated supporting bar 71. It will be noted that as the tines 72 pass downwardly between the channel legs 32, 33 they extend only part way toward the channel wall 34, but at least more than half the distance. Moreover, the upper sprocket wheels 55 and 56 support the chain so that as each set of tines pass over these wheels, the free ends of the tines will be spaced just beneath cap 27.

In use, the improved fare box is disposed to be mounted upright in a bus, trolley or other public conveyance vehicle adjacent its entranceway, so that fares may be dropped through slots 28 and 29 as passengers enter. The motor 51 is adapted to be connected in any conventional manner in circuit with the electrical ignition or drive system of the associated vehicle, so that when the latter is running the motor 51 will be energized, thereby causing the worm 53 continuously to drive the sprocket wheel 55 in a direction which will in turn cause the chain 69 to travel in the direction indicated by the arrows in FIGS. 4 and 6. As the chain travels downwardly through the groove 42 in guide plate 41 under the tension created in the chain by the spring-loaded arm 64, it holds opposite ends of each of the tine supporting bars 71 slidably against the face of the plate 41, so that the associated tines 72 are caused to project at right angles from plate 41 into the space between the channel side walls 32 and 33. Furthermore, it will be noted that as a set of tines 72 passes across the tops of upper sprocket wheels 55 and 56, they will project vertically upwardly toward the underside of the cap 27, so that as they swing over and then downwardly along the outside of the sprocket wheel 55, they will engage and force downwardly through the channel 31 any paper currency, or for that matter any other materials, which may lodged in the top of the channel. These materials then drop out of the bottom of the channel 31 into a space (not illustrated) provided therefor at the bottom of the housing 20.

In practice it has been found that the smaller motor 51 is powerful enough to cause almost all obstructions, which are inserted through the slot 29, to be driven downwardly out of the lower end of channel 31. This is particularly true if the tines 72 are made from a tough spring steel or the like.

During the movement of the chain the idler sprocket wheel 68 on the spring-loaded arm 64 maintains the necessary tension on the chain by virtue of its resilient, rolling engagement with the inside surface of the chain. Although not illustrated, it will be apparent also that additional resilient means can be employed to swing the arm 64 counterclockwise about its pivot pin 62 if necessary to a desirable supplement the effect of torsion spring 65.

From the foregoing it will be apparent that the present invention provides a relatively simple and inexpensive means to obviate the problem heretofore encountered with the currency feeding devices of the type shown in FIG. 1. Applicant's improved fare box has the advantage that the paper currency need only be dropped in any desired fashion through a conventional slot (29) at the top of the box, and does not have to be carefully spread out on a plane surface. This considerably increases the speed with which paper currency can be collected at the entrance to a vehicle. The operator need only to glance at the currency to make sure that it is correct, after which it could be dropped in either folded or unfolded condition into the fare slot 29. If desired, conventional scanning devices could be added to detect or confirm the authenticity of the currency.

A further advantage of this construction is the fact that it is substantially impossible to jam applicant's fare box, particularly as compared to that of the prior art variety shown in FIG. 1, bills must be carefully fed into chute 18 in a perfectly flat or plane condition in order properly to enter the nip between the glass wall 11 and the belt 12, otherwise undesirable jamming is likely to occur at the entrance of the box. Moreover, if other foreign matter is inserted into the chute 18 it can destroy the belt 12 or its drive mechanism. In contrast to this construction, objects dropped downwardly through the slot 29 in applicant's improved box are free to drop downwardly through the chute defined by members 31 and 41, and between the spaced tines 72 to the bottom of the box. However, should any such objects become momentarily lodged in the upper end of such chute, the moving tines 72 will drive then downwardly and through channel 31 to make sure that the channel space is kept clean and ready to accommodate paper currency.

While this invention has been illustrated and described in detail in connection with only certain embodiments thereof, it will be apparent that it is capable of still further modification, and that this application is intended to cover any such modifications as may fall within the scope of one skilled in the art or the appended claims.

I claim:

1. A fare box for transit vehicles and the like, comprising a housing having a closed upper end containing a slot through which paper currency, such as a dollar bill, is adapted to be inserted, means defining a vertical chute in said housing beneath said slot for conveying said currency to the bottom of said housing, said chute having a cross sectional area substantially greater than the cross sectional area of a dollar bill, and large enough normally to permit a folded or rolled bill to drop by gravity through the chute to the bottom of said housing, chute clearing means projecting part way into said chute from one side thereof, and means for repeatedly moving said chute clearing means downwardly in said chute from a point adjacent the upper end thereof to a point adjacent the lower end thereof, thereby to engage and urge downwardly in the chute any object which may have become lodged therein.

2. A fare box as defined in claim 1, wherein said moving means comprises endless belt means mounted to travel substantially in a vertical plane in said box, and with one run of said belt means travelling vertically downwardly in said chute adjacent said one side thereof, and said chute clearing means comprises a plurality of projections extending from the outer surface of said belt means into said chute at spaced points along the length of said belt means, and transverse to the direction of travel of said belt means.

3. A fare box as defined in claim 2, wherein said chute clearing means further comprises a plurality of tine supporting bars secured to said belt means to extend transversely thereof at said spaced points therealong, and said projections comprise a plurality of spaced, parallel, metal tines projecting from each of said bars, and disposed to extend part way only into said chute when the associated bar is conveyed downwardly in said chute by said belt means.

4. A fare box as defined in claim 3, wherein said one side of said chute has on the inside surface thereof a vertical extending groove for slidably guiding therein said belt means during its vertical travel downwardly in said chute, said belt means includes opposite sides, and said tine supporting bars extend beyond said opposite sides respectively of said belt means thereby to slidably overlie marginal portions of said inside surface of said chute during travel of the belt means therethrough.

5. A fare box as defined in claim 1, wherein:

said moving means comprises a sprocket chain mounted to travel in an endless path adjacent said chute, and travelling downwardly inside said chute, and said chute clearing means comprises a plurality of spaced projections on said chain extending part way into said chute during movement of said chain along said inside of said chute.

6. A fare box as defined in claim 5, including an electric motor mounted on said housing, and means drivingly connected said motor to said chain to impart unidirectional movement thereto.

7. A fare box as in claim 5 and including:

adjustable tension means for maintaining said chain under tension.

8. A fare box as in claim 2 and including:

adjustable tension means for maintaining said belt means under tension.

9. A fare box as in claim 1 and wherein:

said housing having an inside wall surface, and, said means for repeatedly moving said chute clearing means is positioned directly behind said chute and secured to said housing inside wall surface.

10. A fare box for transit vehicles and the like comprising a housing closed at its lower end, and having in its upper end a slot for receiving paper currency, such as a dollar bill, means in said housing defining beneath said slot a chute having an inside and an outside surface for conveying to a space at the bottom of the housing any bills inserted into the chute through said slot, a plurality of spaced, flexible, chute clearing projections extending part way only into said chute from said inside surface, and means for repeatedly moving said projections through said chute from the upper end thereof to the lower end thereof, whereby objects passing through said slot into the upper end of said chute are forced downwardly through the chute by said projections.

11. A fare box for transit vehicles and the like comprising, a housing having a slot through which objects such as paper currency are adapted to be inserted, means in said housing including a passageway having in one end an inlet positioned adjacent said slot for receiving said objects, and having in its opposite end an outlet for discharging said objects from the passageway, passageway clearing means in said housing having a first projection extending a substantial distance into said passageway and movable in said passageway from said one end of said passageway adjacent said slot to said other end of said passageway, and having a second projection removed entirely from said passageway, and means associated with said housing and said passageway clearing means for moving said projections successively into said passageway inlet from adjacent said slot and for removing said projections from said passageway outlet, thereby to cause said clearing means to engage, urge and if necessary dislodge any of said objects inserted into said slot and downwardly into said passageway so as to insure delivery of said objects out of said outlet.

12. A fare box for transit vehicles and the like, comprising a housing having in its upper end a narrow slot through which objects such as coins and paper currency may be inserted, means defining on said housing beneath said slot a vertical passageway the upper end of which registers with said slot, and the lower end of which opens on the lower end of said housing, said passageway having a cross sectional area substantially larger than said slot whereby coins and folded or rolled currency, such as dollar bills, are free to drop by gravity downwardly through said passageway to the bottom of said housing, and passageway clearing means moving downwardly in said housing from adjacent the upper to the lower end of said passageway to prevent objects dropped through said slot from becoming lodged in said passageway.

13. A fare box as defined in claim 12, wherein said passageway clearing means comprises a plurality of spaced projections mounted in said housing to travel one after the other vertically downwardly in said passageway from adjacent the upper to the lower end thereof, thereby to engage and force downwardly in the passageway any of said objects which might tend otherwise to become lodged in the passageway.

14. A fare box as defined in claim 13, wherein said clearing means further comprises an endless belt mounted to travel in an endless path in said housing with one run thereof travelling vertically downwardly in said passageway, and said projections are mounted on said belt at spaced points therealong to project transversely therefrom into said passageway.

* * * * *